US007043786B1

(12) United States Patent
Hall et al.

(10) Patent No.: US 7,043,786 B1
(45) Date of Patent: May 16, 2006

(54) PILLOW AND PILLOW COVER

(75) Inventors: Michael J. Hall, Kirkland, WA (US); Timothy A. Hall, Kirkland, WA (US)

(73) Assignee: Quixote Design, Inc., Seattle, WA (US)

( * ) Notice: Subject to any disclaimer, the term of this patent is extended or adjusted under 35 U.S.C. 154(b) by 0 days.

(21) Appl. No.: 10/685,733

(22) Filed: Oct. 14, 2003

(51) Int. Cl.
*A47G 9/00* (2006.01)

(52) U.S. Cl. ..... 5/636; 5/490; 5/657.5; 5/950; 5/952

(58) Field of Classification Search ..... 5/636, 5/645, 638, 657.5, 490, 739, 737, 950, 952
See application file for complete search history.

(56) References Cited

U.S. PATENT DOCUMENTS

| | | | | |
|---|---|---|---|---|
| 2,412,769 | A | 12/1946 | Easterbrooks | |
| 2,483,222 | A * | 9/1949 | Moss | 5/653 |
| 2,659,421 | A * | 11/1953 | Wass et al. | 5/657.5 |
| 2,770,816 | A * | 11/1956 | Reisner | 5/655.9 |
| 3,044,517 | A | 7/1962 | Levi | |
| 3,940,812 | A * | 3/1976 | Zapf | 112/418 |
| 3,959,834 | A | 6/1976 | Hunt | |
| 4,048,675 | A | 9/1977 | Griffin | |
| 4,214,541 | A | 7/1980 | Zeigler, Jr. et al. | |
| 4,224,883 | A | 9/1980 | Zeigler, Jr. et al. | |
| 4,477,515 | A | 10/1984 | Masuda et al. | |
| 4,619,864 | A | 10/1986 | Hendrix et al. | |
| 4,624,198 | A | 11/1986 | Beam et al. | |
| 4,784,248 | A | 11/1988 | Workman | |
| 4,856,439 | A | 8/1989 | O'Neal et al. | |
| 4,893,574 | A | 1/1990 | O'Neal et al. | |
| 4,896,387 | A | 1/1990 | Malcolm et al. | |
| 4,930,173 | A | 6/1990 | Woller | |
| 5,038,691 | A | 8/1991 | Boser | |
| 5,127,117 | A | 7/1992 | Bridges | |
| 5,187,825 | A | 2/1993 | Tesch | |
| 5,228,158 | A | 7/1993 | Park | |
| 5,256,236 | A | 10/1993 | Woller | |
| 5,257,429 | A * | 11/1993 | Genis | 5/636 |
| 5,299,333 | A | 4/1994 | Pedersen et al. | |
| 5,333,563 | A | 8/1994 | Yamanoi | |
| 5,408,712 | A | 4/1995 | Brun | |
| 5,459,894 | A | 10/1995 | Buonocore | |
| 5,513,585 | A | 5/1996 | Diekmann et al. | |
| 5,528,781 | A | 6/1996 | Suzuki et al. | |
| 5,540,167 | A | 7/1996 | Müssig et al. | |
| 5,557,816 | A | 9/1996 | Pedersen et al. | |
| 5,678,262 | A | 10/1997 | Tomlinson | |
| 5,727,266 | A | 3/1998 | Pang | |
| 5,802,644 | A | 9/1998 | Scheurer | |
| 5,843,556 | A | 12/1998 | Levas | |
| 6,009,579 | A | 1/2000 | Pedersen | |
| 6,025,041 | A | 2/2000 | Reuben | |
| 6,230,349 | B1 | 5/2001 | Silver et al. | |
| 6,301,730 | B1 | 10/2001 | Delfs et al. | |
| 6,434,770 | B1 * | 8/2002 | Matthews Brown | 5/636 |
| 6,618,881 | B1 | 9/2003 | Hart et al. | |

* cited by examiner

*Primary Examiner*—Alexander Grosz
(74) *Attorney, Agent, or Firm*—Fredrikson & Byron, P.A.

(57) ABSTRACT

A fast-drying pillow and accompanying pillow cover. The fast-drying pillow is preferably manufactured of a fast-drying material such as nylon. The pillow includes a component for receiving a suspension device to enable the pillow to be suspended for air drying. The pillow cover includes overlapping flaps to minimize the infiltration of dirt into the cover and onto the pillow.

45 Claims, 14 Drawing Sheets

PILLOW AND PILLOW COVER

FIELD OF THE INVENTION

The present inventions relates generally to beds. More particularly, the present invention relates to support means for the head and/or neck of a user (e.g., a pillow).

BACKGROUND OF INVENTION

Pillows are widely used to provide comfort while sleeping, relaxing, meditating, etc. A travel pillow is one example of a pillow. When traveling, people often desire to bring along a pillow to provide for comfortable sleeping during their travels. Typically, it is desirable that travel pillows be smaller then standard bedding pillows to facilitate packing. A general goal of "travel" pillows is that they be suitable for compact storage so that they do not take up too much valuable storage space. While being suitable for compact storage, it is also desirable that travel pillows be comfortable and simulate standard pillows in this regard. As travel pillows may be used in unprotected environments another goal of such pillows is that they are able to be easily cleaned.

A common problem with pillows when traveling is that they may become dirty and require washing, and subsequent drying, or may become wet and require drying. This is especially a problem in travel situations such as camping. When the pillow becomes dirty and is cleaned, it is typically necessary to hang the pillow to allow the pillow to dry. This may be accomplished with clothespins or by otherwise gerry-rigging a suspension of the pillow. Alternately, the pillow is left unsuspended to dry, requiring longer drying time.

A related problem is the frequency with which such pillows become dirty. If used outdoors, it is likely that the pillow will come into contact with the ground or dirt. It is, obviously, undesirable to sleep on a dirty pillow. For this reason, a washable pillow cover may be used to protect the pillow. For insertion of the pillow into the pillow cover and subsequent removal of the pillow from the pillow cover, an opening must be provided in the pillow cover. When using a pillow cover, the pillow cover can be removed from the pillow and washed without requiring washing of the pillow. Unfortunately, dirt may make its way through the opening of the pillow cover and onto the pillow, thereby soiling the pillow. Thus, it is still often required to wash the pillow. Further, depending on the placement of any seam, the seams of the pillow cover may be uncomfortable against the face.

SUMMARY OF INVENTION

The present invention relates to a compactable pillow that is configured for fast drying and a pillow cover suitable for preventing soiling of the pillow is disclosed. In particular, the pillow includes a component, for example a loop, for receiving a suspension device. The pillow cover has overlapping flaps to allow receipt of the pillow while minimizing infiltration of dirt through an the pillow cover. The flaps overlap in a manner to maximize surface area of the pillow for comfort while minimizing infiltration of dirt onto the pillow.

The pillow of the present invention man be configured as any shape. In one embodiment, the pillow comprises two sheets of generally rectangular material, each sheet having a top edge, a bottom edge, and two side edges, four corners being formed by the meeting of the edges. The first sheet is sewn or otherwise attached to the second sheet, along the top edge, bottom edge, and side edges, to form the outer casing of the pillow. The stitching may be especially durable, for example with double stitching. As an alternative to stitching, the first sheet may be attached to the second sheet via heat sealing or other suitable method. Optionally, a cording or piping is provided along the seam between the first and second sheets. The sheets of material may be made of nylon or other suitable material. The outer casing is stuffed with a fill material.

A component for enabling the pillow to be suspended is provided on the pillow. In one embodiment, the component is a loop for receiving a suspension device and is provided at a point along the perimeter of the pillow. The component may be an extension of the cording or piping optionally provided along the seam between the first and second sheets. Alternately, the component may be separately applied to the pillow. The component may be provided at one of the corners of the outer casing where it is seamed between the first and second sheets of material. Using the component, the pillow may be suspended from a suspension device to air dry. The component may also be used for other purposes such as, for example, receiving a hook for attaching the pillow to a backpack during travel.

In one embodiment, the pillow cover of the present invention comprises a front cloth and a back cloth, each cloth having top bottom, left and right edges and the front and back cloths being disposed to meet along the top, bottom, left and right edges. The pillow cover is preferably configured to approximately match the dimensions of the pillow. The bottom, left, and right edges of the front and back cloths are seamed together. The top edge is left open to allow the pillow to be inserted in the cover. Additionally, each of the front and back cloths is provided with a flap that extends over the top of the pillow when the pillow is inserted in the cover. The flaps are designed to extend over the top of the pillow, as inserted into the cover. Thus, the pillow is inserted, the back flap is extended over the top of the pillow to the front side and the front flap is extended over the back flap to the back side. The flap arrangement minimizes the infiltration of the dirt into the pillow cover. The extension of the front flap over the back flap to the back side is designed to end at a curve along the back side of the pillow cover. This design maximizes the surface are of the back side not covered by the front flap.

DETAILED DESCRIPTION OF THE PREFERRED EMBODIMENTS

The following detailed description should be read with reference to the drawings, in which like elements in different drawings are numbered identically. The drawings, which are not necessarily to scale, depict selected embodiments and are not intended to limit the scope of the invention. Examples of constructions, materials, dimensions, and manufacturing processes are provided for selected elements. All other elements employ that which is known to those of skill in the field of the invention. Those skilled in the art will recognize that many of the examples provided have suitable alternatives that can be utilized.

Figure 1:
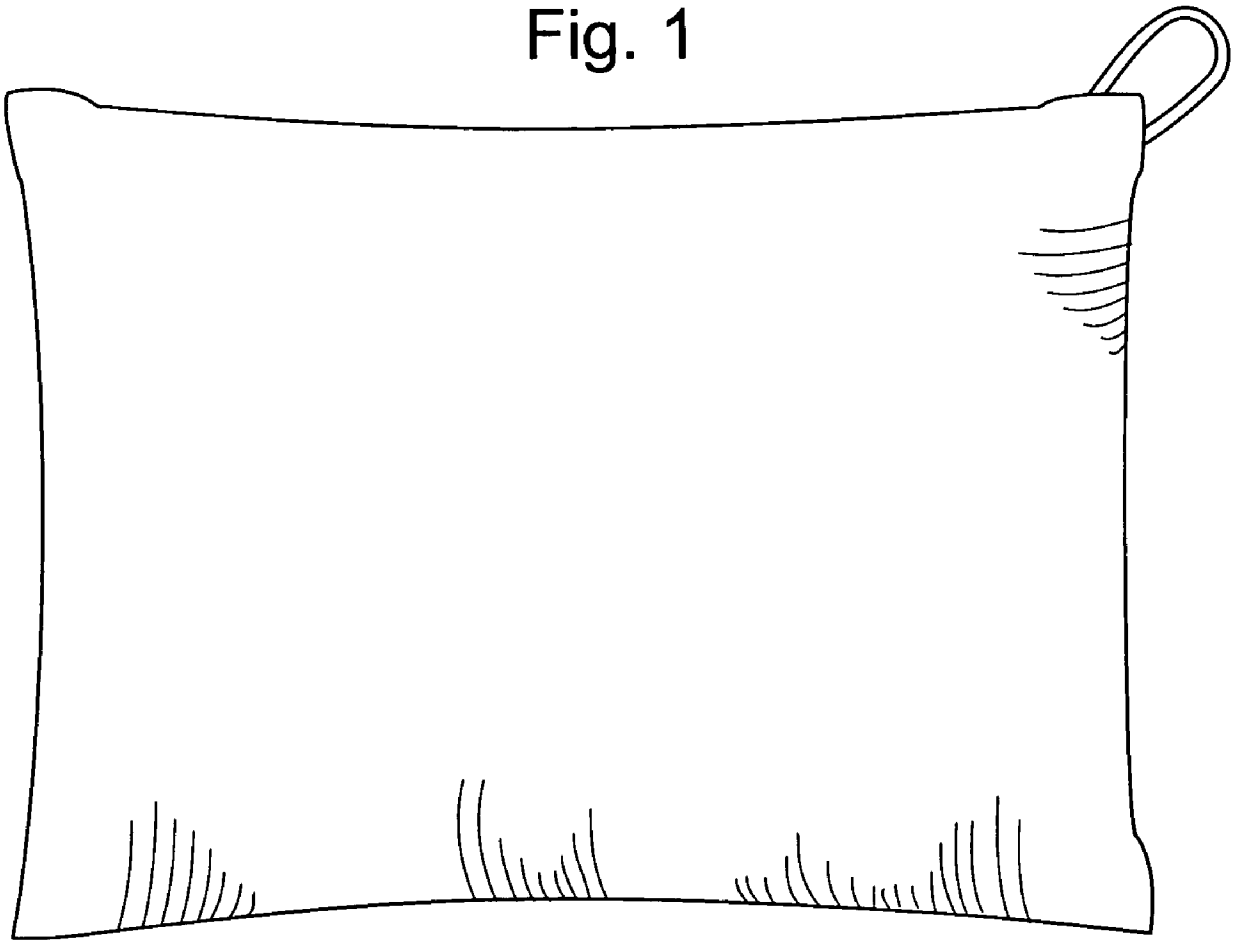
FIG. 1 is a plan view illustrating a pillow in accordance with an exemplary embodiment of the present invention.

FIG. 1 is a plan view illustrating a pillow in accordance with an exemplary embodiment of the present invention. Of course, the pillow can be configured in any shape or size but should be suitable for travel. The pillow includes an outer casing that is stuffed with a fill material such as down, synthetic down, polyester, poly fiber, cotton, wool or other suitable fill. Desirably, the fill is such that the pillow may be compacted to a size smaller than its size uncompacted. In the embodiment shown, the outer casing comprises first and second sheets of material. It is desirable for the first and second sheets to be manufactured of a relatively fast-drying material such as nylon. Alternately, the sheets may be manufactured of Polartec or other suitable material.

In the embodiment of FIG. 1, the first and second sheets of material mirror one another; each sheet of material is a rectangle having top, bottom, and side edges. The first and second sheets of material are sewn, or otherwise attached, together along the edges to form the outer casing. The attachment of the first sheet to the second sheet provides seams along the top, bottom, and side edges. The seams may be stitched with especially durable stitching. For example, the seams may be double stitched. Alternately, the seams may be provided via heat sealing or other suitable method. As an alternative to providing first and second sheets of material seamed together, the pillow casing may be formed of a single sheet of material folded and seamed along three edges.

A component for receiving a suspension device is provided on the pillow. In the embodiment of FIG. 1, the component is positioned along the seam of the outer casing. In the embodiment shown, the component comprises a loop. In order to reinforce attachment of the component to the pillow, it is desirable that the component be provided within the seam of the first sheet of material to the second sheet of material. However, the component may be attached to the pillow at any suitable location in any suitable manner. The component may be elastic or other soft, flexible material such that the component does not interfere with the comfort of the pillow.

In use, the component may be used to receive a hook or other suspension device. The pillow may be suspended, using the component, for air drying. Alternately, the component may be used for suspending the pillow to a backpack or other device for easy transport, or for other suitable use.

Figure 2:
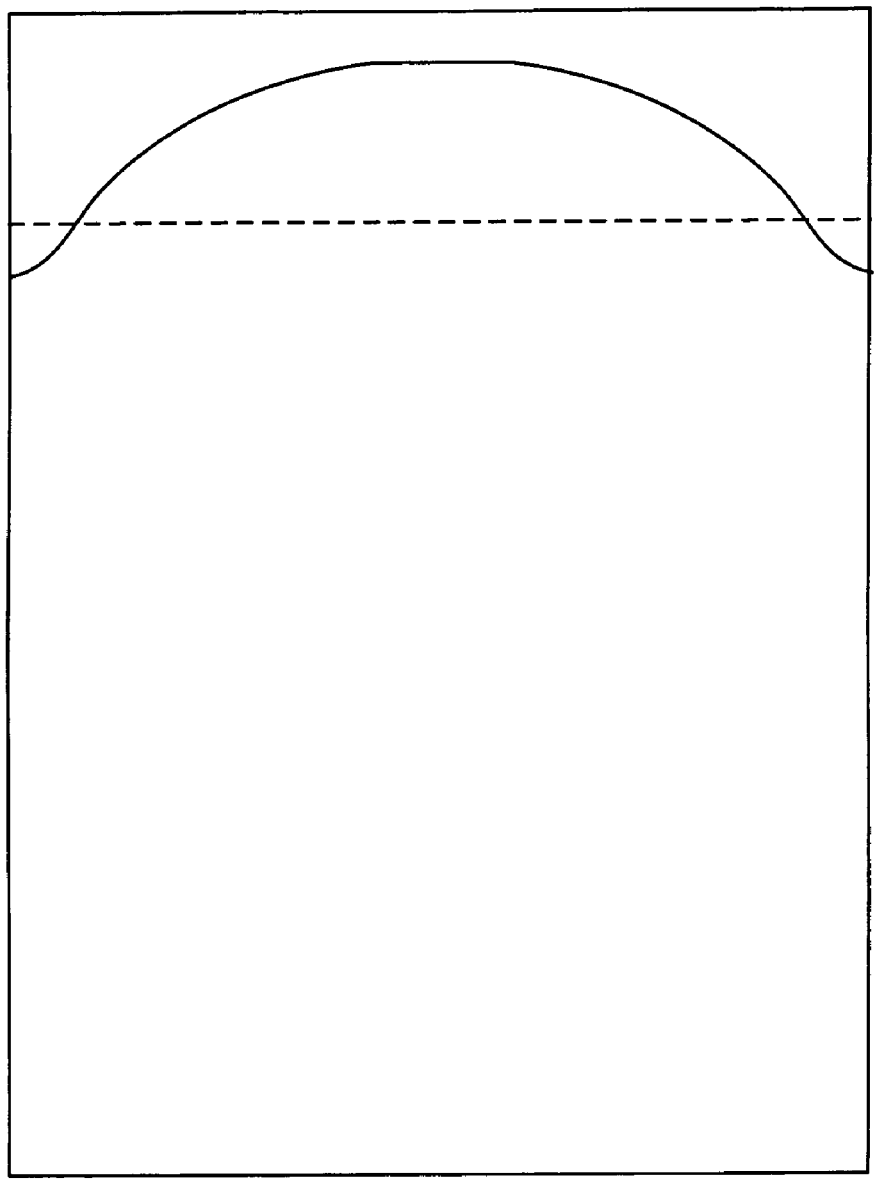
FIG. 2 is a plan view illustrating a pillow cover in accordance with one embodiment of the present invention.

FIG. 2 is a plan view illustrating a pillow cover in accordance with one embodiment of the present invention. The pillow cover of FIG. 2 is coordinated to the pillow shown in FIG. 1. That is, the shape and size of the pillow cover of FIG. 2 is configured to receive the pillow of FIG. 1. As with the pillow, the pillow cover may be provided in any shape or size desired. The pillow cover comprises a front cloth and a back cloth that meet along the top, bottom, left and right edges. Alternately, the pillow cover may comprise a single cloth. The cloth or cloths may be manufactured of any material. Depending on usage, the material may be rugged and capable of use in extreme environments or may be soft and comfortable against the skin. Regardless, it is desirable that the material of the pillow cover be suitable for washing. Example materials include cotton, nylon, Polartec, jersey knit, polyester, and fleece. The bottom, left, and right edges of the front and back clots are seamed together. Of course, if only one sheet of material is used, one of the seams is substituted with a fold of the material.

The top edge of the cover is not seamed, allowing the pillow to be inserted in the cover. It should be appreciated that any edge of the pillow, not necessarily the top edge, may be alternately left open. The choice of the top edge is intended merely to be illustrative. Whichever edge is not seamed leaves an opening through which the pillow is inserted. Each of the front and back cloths is provided with a flap at the top edge that extends over the top of the pillow when the pillow is inserted in the cover. Of course, if an edge other than the top edge is left open, the flaps are provided at that edge. The flaps are designed such that each of the flaps extend over the top of the pillow, as inserted into the cover. Thus, the pillow is inserted, the back flap is extended over the top of the pillow to the front side and the front flap is extended over the back flap to the back side, the flaps overlapping one another. The front flap ends in a curve. The front flap is preferably designed such that it extends over the back flap and the back side of the pillow cover only to an extent minimizing infiltration of dirt into the pillow cover while maximizing surface area of the back side of the pillow cover not covered by the front flap.

As seen in FIG. 2, the flaps are seamed along the side edges of the pillow. The back flap may end in a curve or other shape. As the front flap has minimal impact on the comfort of the back side of the pillow cover, the pillow may be used with either the front side or the back side of the pillow cover up. In this manner, if the front side of the pillow cover were to become slightly wet or dirty, the pillow could be flipped and the back side of the pillow over used.

Further, a compression bag may be provided with the pillow and, optionally, the pillow cover, such that insertion of the pillow into the compression bag compacts the pillow and causes the pillow to decrease in volume. It should be appreciated, however, a compression bag is not necessary to compact the pillow. If it is desired to compact the pillow without a compression bag, the pillow may be compacted, for example, by packing it into a small space in a backpack or suitcase.

Figure 3:
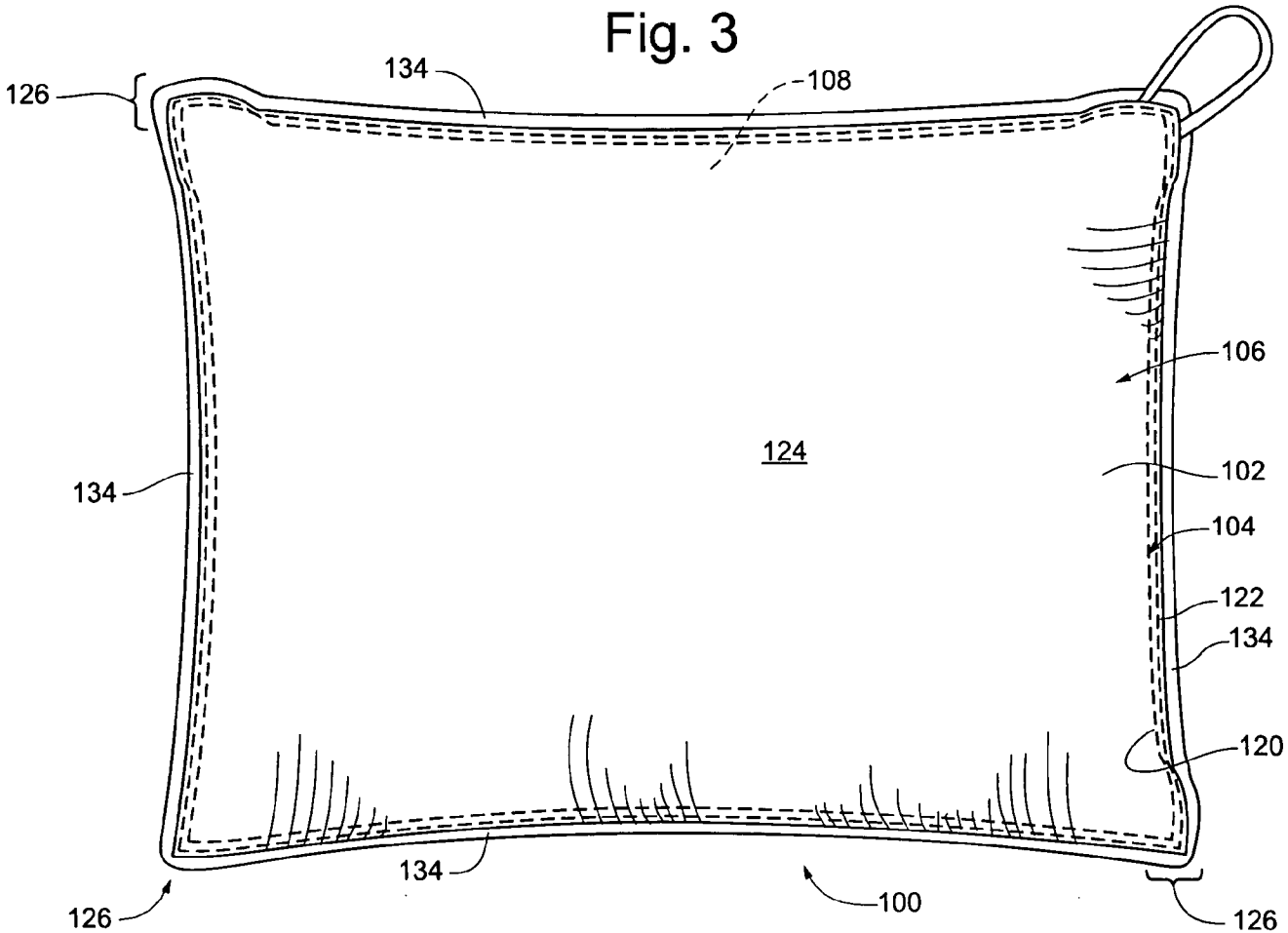
FIG. 3 is a plan view of a pillow in accordance with an additional exemplary embodiment of the present invention.

FIG. 3 is a plan view of a pillow 100 in accordance with an additional exemplary embodiment of the present invention. Pillow 100 of FIG. 1 comprises a first panel 102 and a second panel (not visible in FIG. 3) that are coupled together at a seam 104. In the embodiment of FIG. 3, the first panel and the second panel form a casing 106 that defines a cavity 108.

In the embodiment of FIG. 3, seam 104 comprises an inner line of stitches 120 and an outer line of stitches 122. A central portion 124 of first panel 102 extends inwardly from inner line of stitches 120. A flange 126 of pillow 100 extends outwardly from cavity 108 defined by casing 106. As shown in FIG. 3, inner line of stitches 120 and outer line of stitches 122 are both disposed on flange 126 of pillow 100. A bead 134 of flange 126 is shown encircling pillow 100 in FIG. 3.

Figure 4:
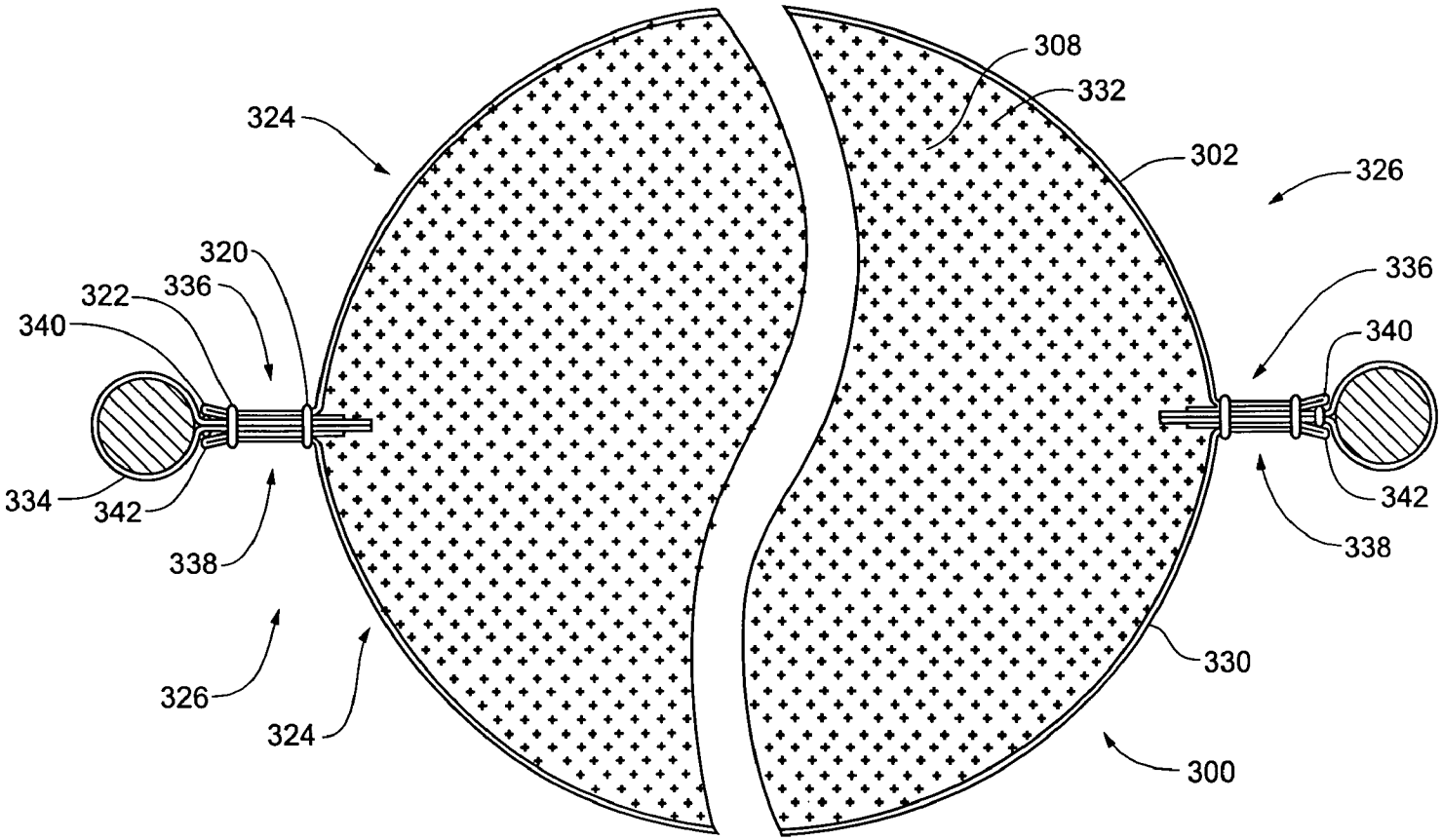
FIG. 4 is a cross sectional view of a pillow in accordance with an additional exemplary embodiment of the present invention.

FIG. 4 is a cross sectional view of a pillow 300 in accordance with an additional exemplary embodiment of the present invention. Pillow 300 of FIG. 4 comprises a first panel 302 and a second panel 330 that define a cavity 308. With reference to FIG. 4, it will be appreciated that a fill 332 is disposed in cavity 308.

In some useful embodiments of the present invention, fill 332 provides mechanical resistance to compression. Fill 332 may comprise various materials without deviating from the spirit and scope of the present invention. Materials that may be suitable in some applications include down (e.g., goose down) and fiber fill. One fiber fill that may be suitable for use in some applications is identified by the tradename PRIMALOFT, this material is commercially available from Albany International Corp. of Albany, New York.

In the embodiment of FIG. 4, an inner line of stitches 320 and an outer line of stitches 322 fix a first peripheral portion 336 of first panel 302 and a second peripheral portion 338 of second panel 330 relative to one another. With reference to FIG. 4, it will be appreciated that first peripheral portion 336 of first panel 302 includes a first fold 340. With continuing reference to FIG. 4, it will also be appreciated that second peripheral portion 338 of second panel 330 includes a second fold 342.

In FIG. 4, a central portion 324 of first panel 302 is shown extending inwardly from inner line of stitches 320. Similarly, a central portion 324 of second panel 330 extends inwardly from inner line of stitches 320. A flange 326 of pillow 300 extends outwardly from cavity 308. As shown in FIG. 4, inner line of stitches 320 and outer line of stitches 322 both extend through a flange 326 of pillow 300. With reference to FIG. 4, it will be appreciated that flange 326 comprises a bead 334.

Figure 5:
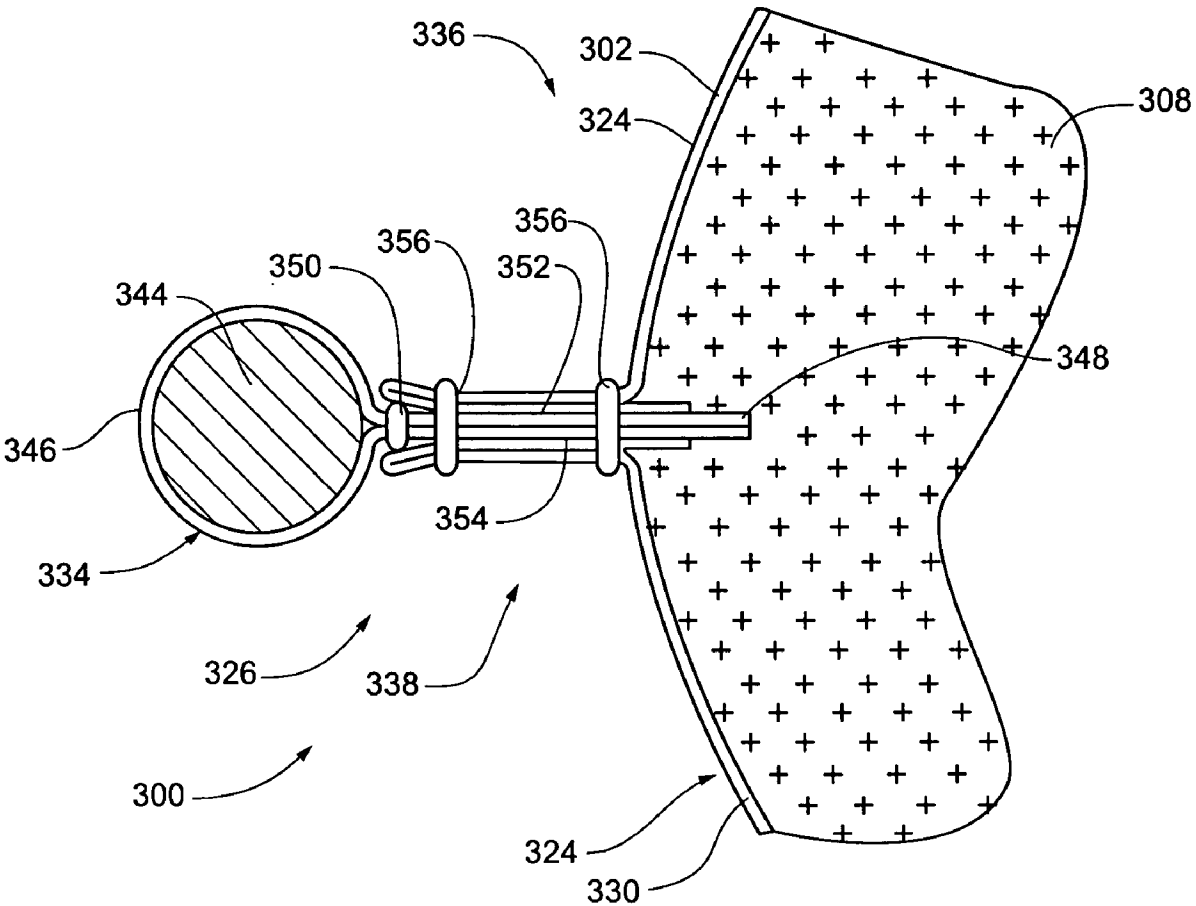
FIG. 5 is an enlarged cross sectional view illustrating a flange of a pillow shown in the previous figure.

FIG. 5 is an enlarged cross sectional view illustrating flange 326 of pillow 300 shown in the previous figure. In the embodiment of FIG. 5, flange 326 of pillow 300 includes a bead 334. In the embodiment of FIG. 5, bead 334 comprises a cord 344 and a wrap 346 that is disposed about cord 344. In the embodiment of FIG. 5, a tail 348 of wrap 346 extends between first peripheral portion 336 of first panel 302 and second peripheral portion 338 of second panel 330. In the embodiment of FIG. 5, a third line of stitches 350 extends through wrap 346.

In FIG. 5, a first airflow path 352 is shown at the interface between wrap 346 and first peripheral portion 336 of first panel 302. Also in FIG. 5, a second airflow path 354 is shown at the interface between wrap 346 and second peripheral portion 338 of second panel 330. Additionally, a plurality of needle holes 356 are shown extending through flange 326 of pillow 300. With reference to FIG. 5, it will be appreciated that central portion 324 of first panel 302 and central portion 324 of second panel 330 are free of needle holes in the embodiment of FIG. 4 and FIG. 5.

In some useful embodiments of the present invention, first panel 302 and second panel 330 are capable of directing air disposed within cavity 308 toward flange 326 during compression of pillow 300. For example, a volume of air may exit cavity 308 via first airflow path 352, second airflow path 354, and needle holes 356. In some cases, the first panel 302 and second panel 330 are sufficiently impermeable that the volume of air exiting cavity 308 proximate flange 326 during compression of pillow 300 is greater than a volume of air passing through first panel 302 and second panel 330 during compression of pillow 300. When this is the case, pillow 300 may be capable of providing balloon-like cushioning. The cushioning provided by pillow 300 may be a combination pneumatic cushioning provided by a casing of pillow 300 and mechanical cushioning provided by fill 332.

Figure 6:
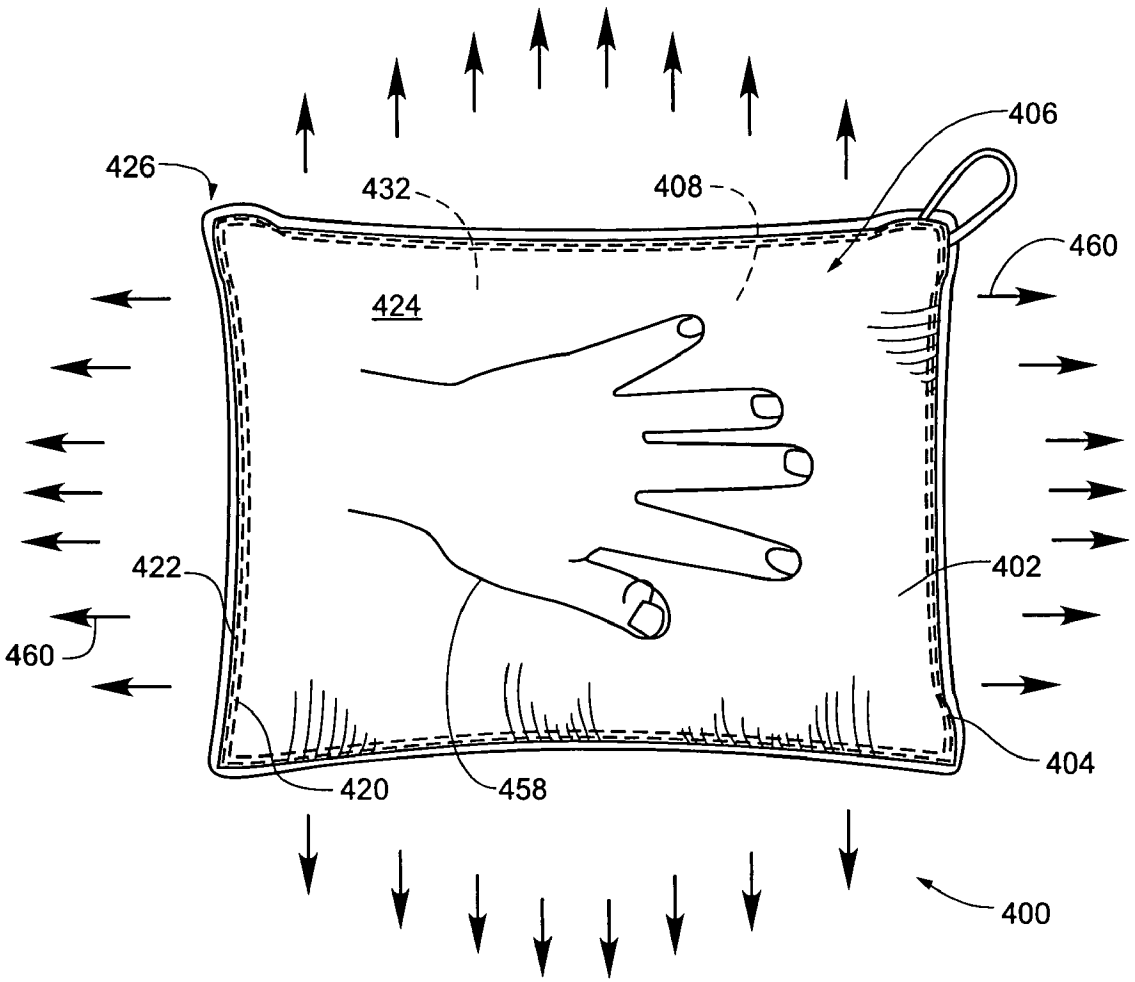
FIG. 6 is a plan view of a pillow in accordance with yet another exemplary embodiment of the present invention.

FIG. 6 is a plan view of a pillow 400 in accordance with yet another exemplary embodiment of the present invention. Pillow 400 of FIG. 6 comprises a first panel 402 and a second panel (not visible in FIG. 6) that are coupled together at a seam 404. In the embodiment of FIG. 6, the first panel and the second panel form a casing 406 that defines a cavity 408.

In the embodiment of FIG. 6, a hand 458 is shown compressing pillow 400. In the embodiment of FIG. 6, air 460 is shown exiting pillow 400 as it is compressed. In FIG. 6, air 460 is illustrated using a plurality of arrows. With reference to FIG. 6, it will be appreciated that air 460 is exiting cavity 408 proximate seam 404.

In the embodiment of FIG. 6, seam 404 comprises an inner line of stitches 420 and an outer line of stitches 422. A central portion 424 of first panel 402 extends inwardly from inner line of stitches 420. A flange 426 of pillow 400 extends outwardly from cavity 408 defined by casing 406. As shown in FIG. 6, inner line of stitches 420 and outer line of stitches 422 are both disposed on flange 426 of pillow 400.

In some cases, casing 406 is sufficiently impermeable that the volume of air exiting cavity 408 proximate seam 404 during compression of pillow 400 is greater than a volume of air passing through casing 406 during compression of pillow 400. The cushioning provided by pillow 400 may be a combination pneumatic cushioning provided by casing 406 of pillow 400 and mechanical cushioning provided by a fill 432 that is disposed in cavity 408. In the embodiment of FIG. 6, pillow 400 may be capable of providing parachute-like resistance.

Figure 7:
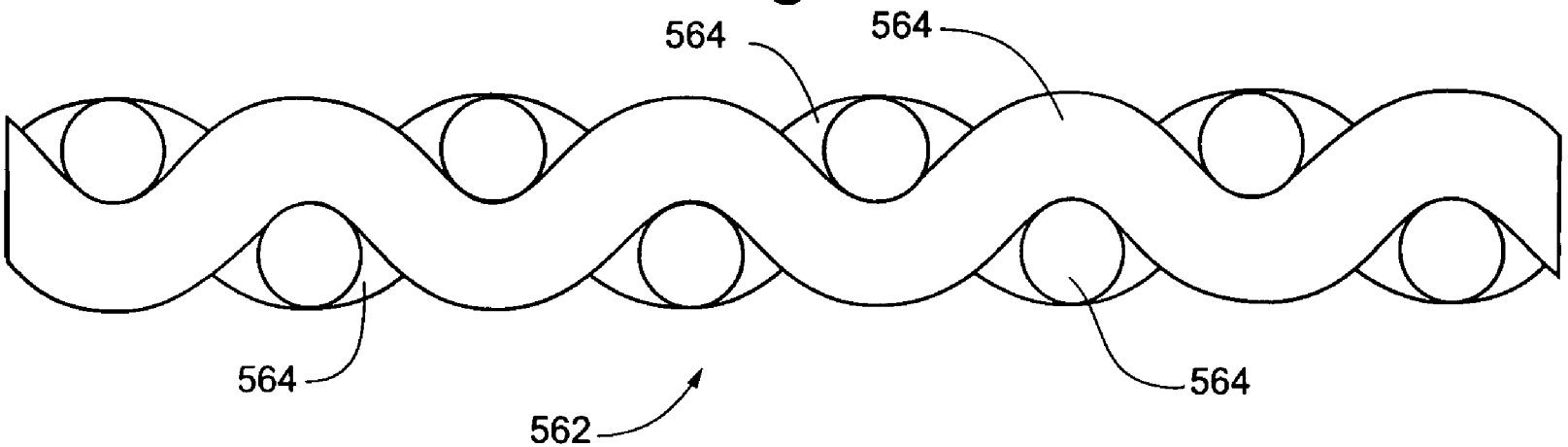
FIG. 7 is a cross-sectional view of a panel in accordance with an exemplary embodiment of the present invention.

FIG. 7 is a cross-sectional view of a panel 562 in accordance with an exemplary embodiment of the present invention. In the embodiment of FIG. 7, panel 562 comprises a plurality of yarns 564 that are disposed in an interwoven arrangement. Yarns 564 of panel 562 may comprise various materials without deviating from the spirit and scope of the present invention. For example, yams 564 may comprise thermoplastic or non-thermoplastic materials. Examples of thermoplastic materials that may be suitable in some applications include: polyethylene (PE), polypropylene (PP), polyvinylchloride (PVC), polyurethane, polytetrafluoroethylene (PTFE), polyamide, polyimide, polyethylene terephthalate (PET), and polyethylene terephthalate glycol (PETG).

Figure 8:
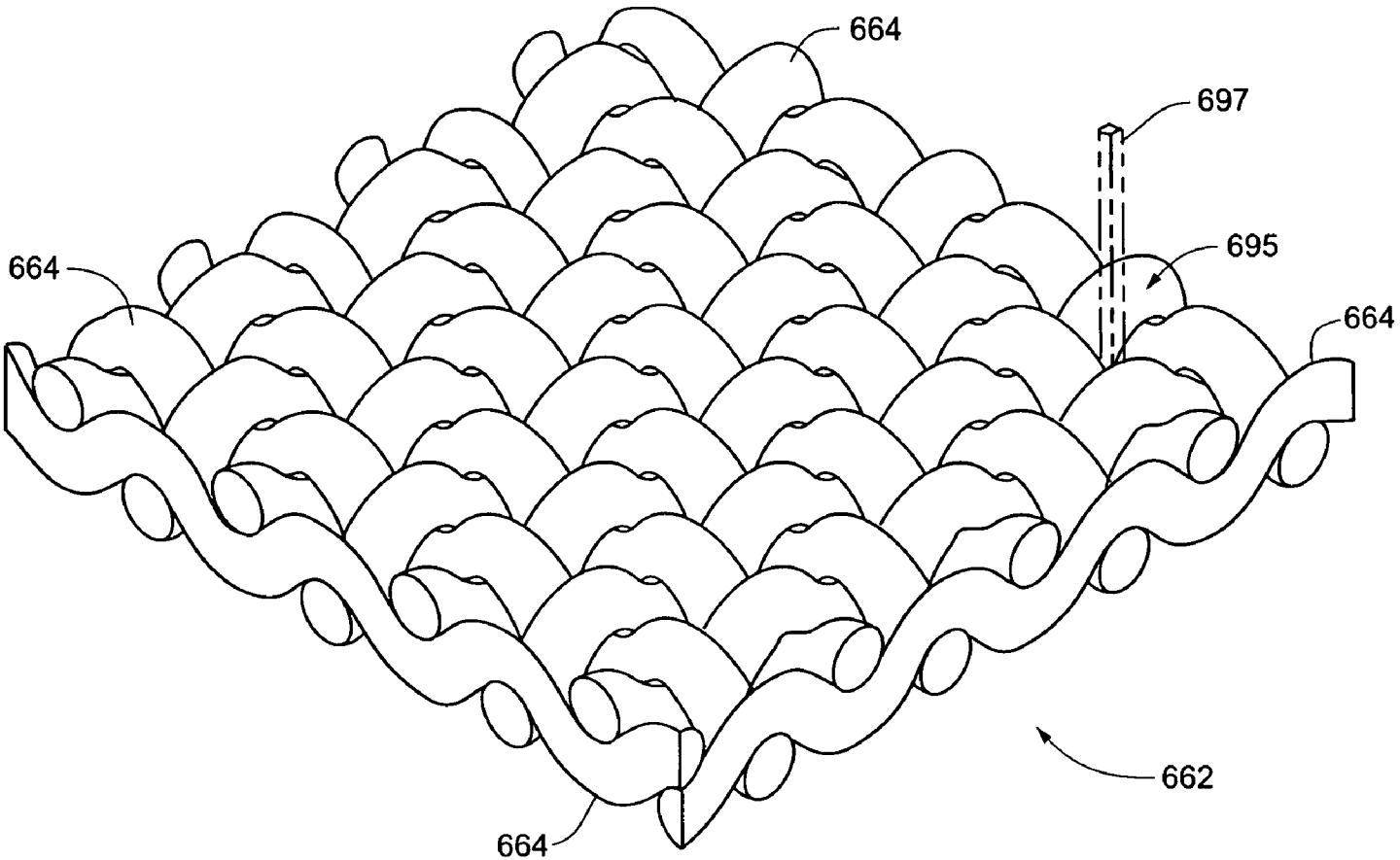
FIG. 8 is an isometric view of a panel in accordance with an exemplary embodiment of the present invention.

FIG. 8 is an isometric view of a panel 662 in accordance with an additional exemplary embodiment of the present invention. In the embodiment of FIG. 8, panel 662 comprises a plurality of yarns 664. In the embodiment of FIG. 8, yarns 664 are disposed proximate one another in an interwoven arrangement. In some embodiments of the present invention, a panel may comprise a plurality of yarns defining a plurality of interstitial spaces. In FIG. 8, a projection 697 of an interstitial space 695 is illustrated using phantom lines. It will be appreciated that an panel may define interstitial spaces having shapes other than the one illustrated in FIG. 8 without deviating from the spirit and scope of the present invention.

Figure 9:
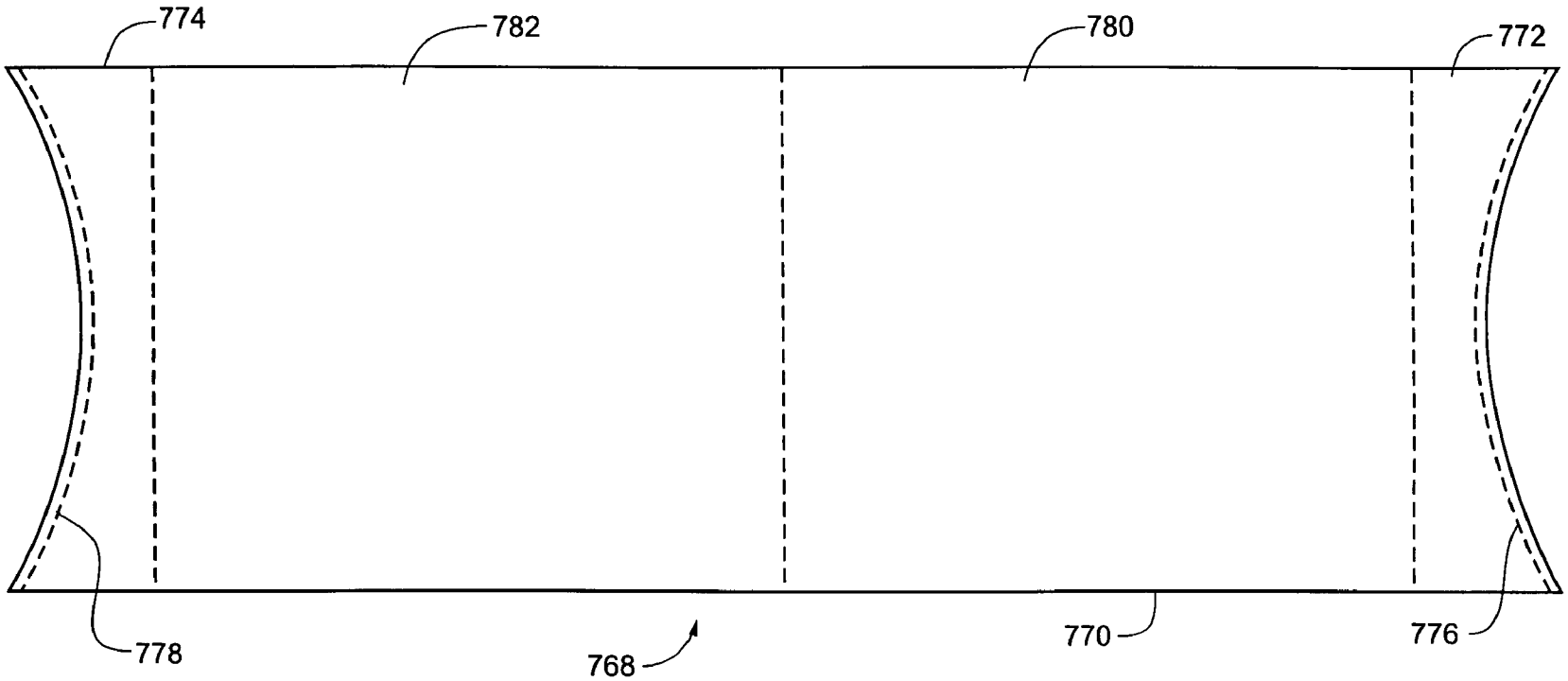
FIG. 9 is a plan view of a blank in accordance with an exemplary embodiment of the present invention.

FIG. 9 is a plan view of a blank 768 in accordance with an exemplary embodiment of the present invention. In the embodiment of FIG. 9, blank 768 comprises a single piece of fabric 770. Blank 768 comprises an outer flap 772 and an inner flap 774. Outer flap 772 is finished with a first hem 776. Similarly, inner flap 774 is finished with a second hem 778. Blank 768 also comprises a first sheet 780 and a second sheet 782.

Figure 10:
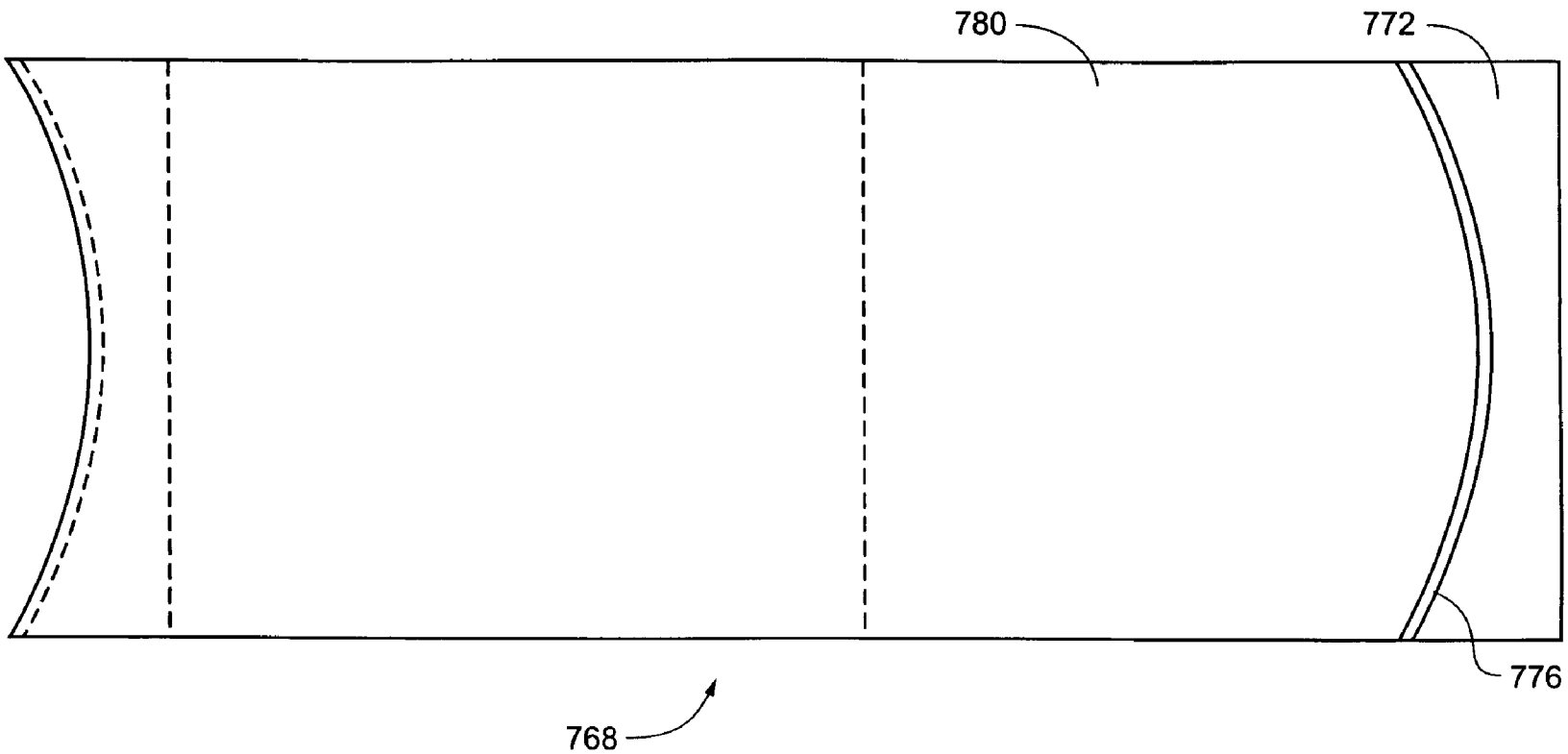
FIG. 10 is an additional plan view of a blank shown in the previous figure.

FIG. 10 is an additional plan view of blank 768 shown in the previous figure. In the embodiment of FIG. 10, blank 768 has been folded so that outer flap 772 is overlaying first sheet 780. First hem 776 can be seen in FIG. 10.

Figure 11:
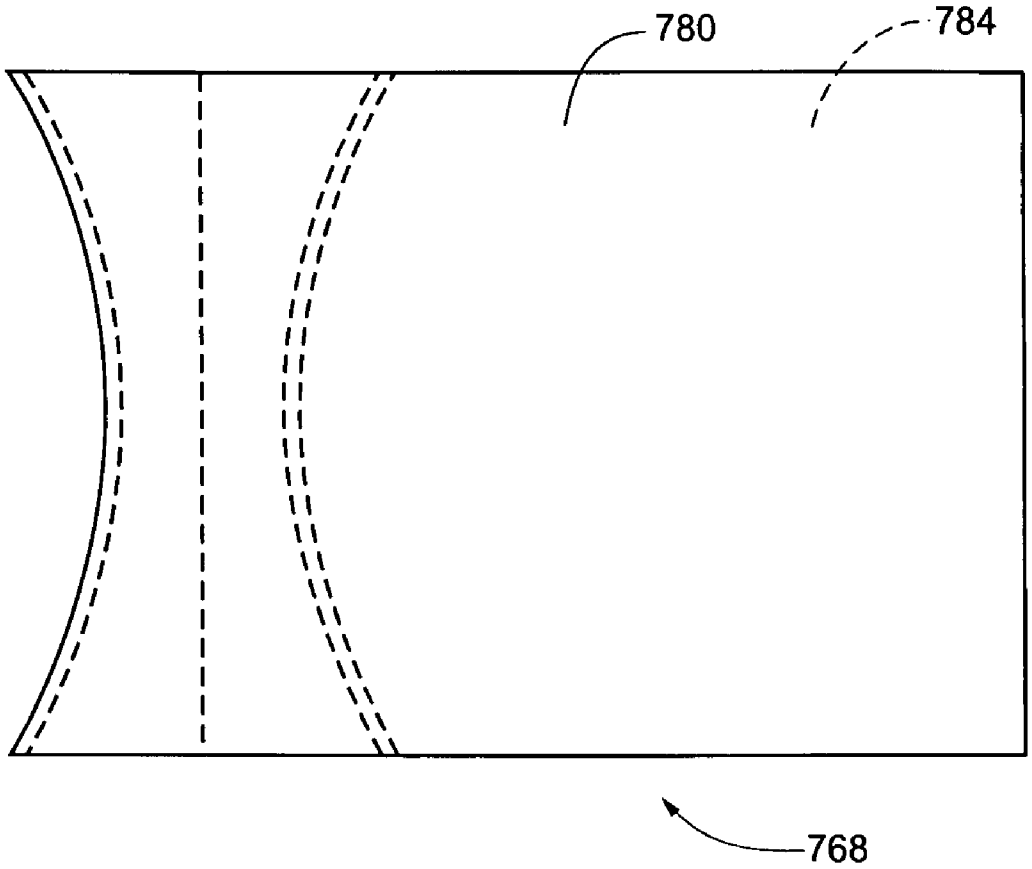
FIG. 11 is an additional plan view of a blank shown in the previous figure.

FIG. 11 is an additional plan view of blank 768 shown in the previous figure. In the embodiment of FIG. 11, blank 768 has been folded so that first sheet 780 overlays second sheet 782. With reference to FIG. 11, it may be appreciated that first sheet 780 and second sheet 782 define a pocket 784. In some methods in accordance with the present invention, blank 768 can be used to fabricate a pillowcase. When this is the case, pocket 798 may be dimensioned to receive a pillow.

Figure 12:
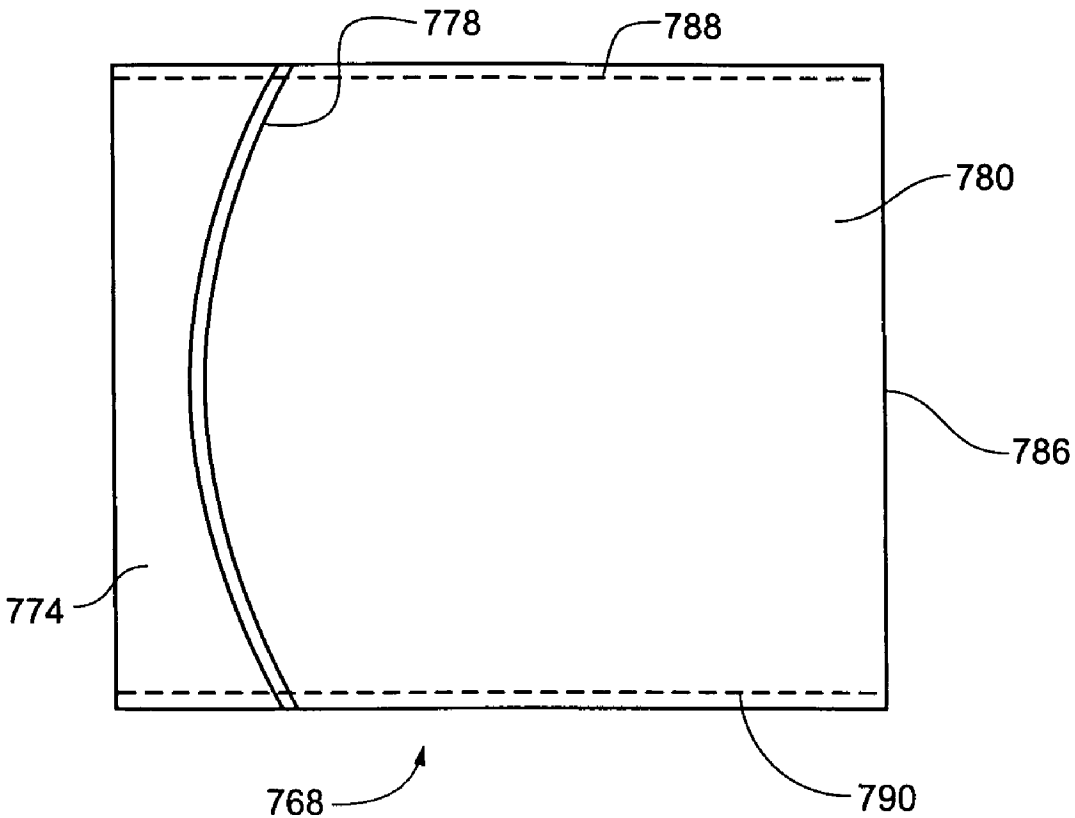
FIG. 12 is an additional plan view of a blank shown in the previous figure.

FIG. 12 is an additional plan view of blank 768 shown in the previous figure. In the embodiment of FIG. 12, blank 768 has been folded so that inner flap 774 overlays first sheet 780. Accordingly, second hem 778 is visible in FIG. 12. With reference to FIG. 12, it will be appreciated that blank 768 has been sewn to form a pillowcase 786. Pillowcase 786 includes a first stitch row 788 and a second stitch row 790. First stitch row 788 and second stitch row 790 may serve to fix inner flap 774, outer flap 772, first sheet 780 and second sheet 782 relative to one another.

Figure 13:
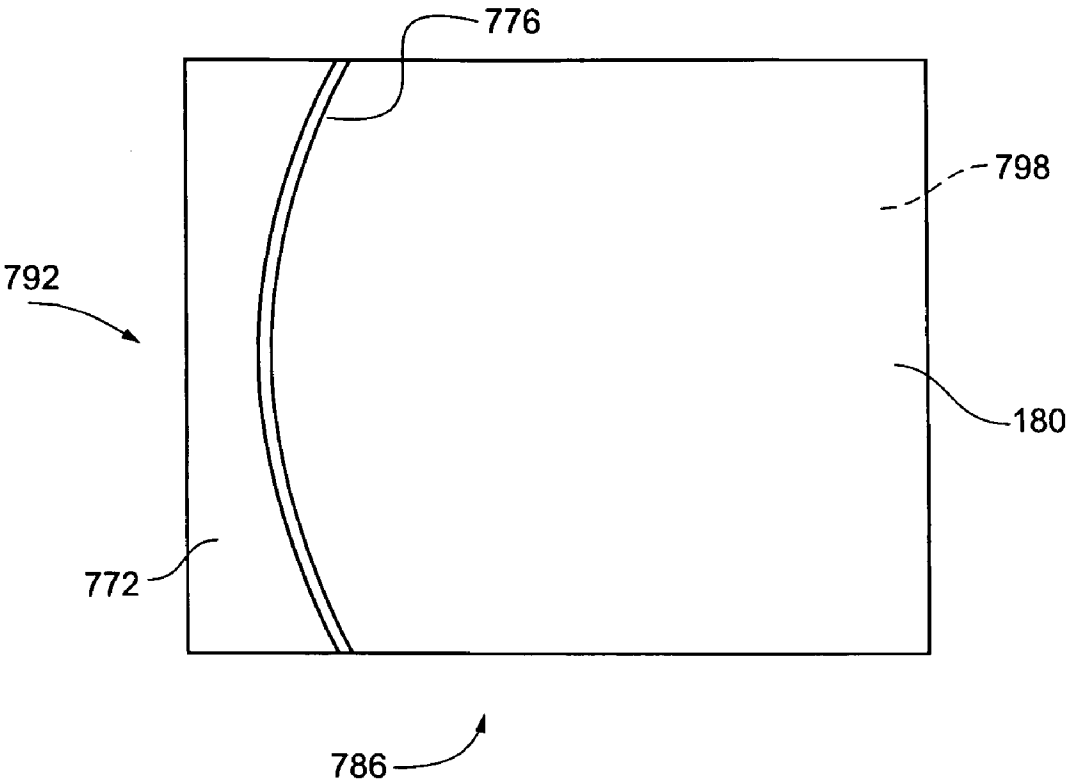
FIG. 13 is a plan view of a pillowcase shown in the previous figure.

FIG. 13 is a plan view of pillowcase 786 shown in the previous figure. In FIG. 13, pillowcase 786 has been turned inside out, relative to the configuration shown in the previous figure. Outer flap 772 can be seen overlaying first sheet 780 in FIG. 13. First hem 776 is also visible in FIG. 13. In the embodiment of FIG. 13, first sheet 780 and second sheet 782 define a pocket 798.

In some useful embodiments of the present invention, outer flap 772 is capable of assuming an open position in which a mouth 792 of pillowcase 786 is open and a closed position in which outer flap 772 covers mouth 792 of pillowcase 786. When mouth 792 of pillowcase 786 is open, cavity 798 of pillowcase 786 communicates with the outer atmosphere via mouth 792. In FIG. 13, outer flap 772 is disposed in the open position.

Figure 14:
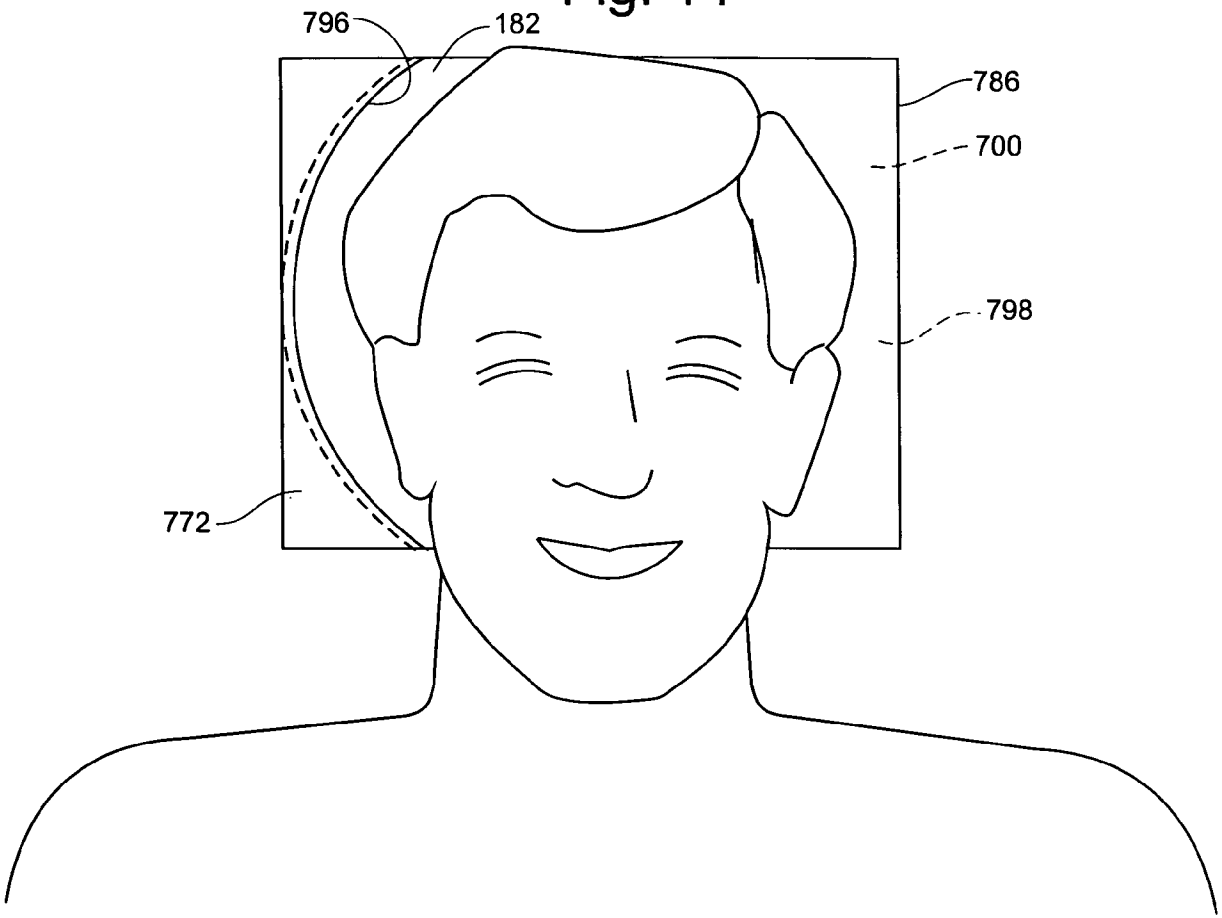
FIG. 14 is a plan view showing a pillowcase shown in the previous figure.

FIG. 14 is a plan view including pillowcase 786 shown in the previous figure. In the embodiment of FIG. 14, outer flap 772 is disposed in the closed position. In other words, outer flap 772 has been turned inside out relative to the configuration shown in the previous figure. In FIG. 14, outer flap 772 can be seen overlaying second sheet 182. In the embodiment of FIG. 14, a pillow 700 is disposed in pocket 798. With reference to FIG. 14, it will be appreciated that outside flap 794 includes an arcuate edge 796. In some useful embodiment of the present invention, arcuate edge 796 is dimensioned to receive the head of a person using pillow 700 and pillowcase 786. Also with reference to FIG. 14, it will be appreciated that arcuate edge 796 of outer flap 772 serves to expose additional surface of second sheet 782, making that surface available for use by a person using pillowcase 786 and pillow 700.

A pillowcase in accordance with an exemplary embodiment of the present invention may comprise a first sheet and a sheet defining a pocket. The pillowcase may also comprise an outer flap having an open position in which the pocket is accessible and a closed position in which the outer flap covers a mouth of the cavity. The outer flap may comprise an arcuate edge that is shaped to receive a human head.

While particular embodiments in accordance with the present invention have been shown and described, it is understood that the invention is not limited thereto, and is susceptible to numerous changes and modification as would be obvious those skilled in the art. Therefore, the invention is not limited to the details shown and described herein, and includes all such changes and modifications as encompassed by the scope of the appended claims.

What is claimed is:

1. A pillow, comprising:

a first panel and a second panel coupled together by a seam to form a pillow casing defining a cavity;

a fill disposed in the cavity;

the fill providing mechanical resistance to compression; and the casing providing pneumatic resistance to compression, wherein the first panel comprises a plurality of yarns defining a plurality of interstitial spaces, the interstitial spaces being dimensioned such that a volume of air exiting the cavity proximate the seam during compression of the pillow is greater than a volume of air passing through the first panel during compression of the pillow.

2. The pillow of claim 1, wherein the yarns comprise a thermoplastic material.

3. The pillow of claim 2, wherein the thermoplastic material comprises polyamide.

4. The pillow of claim 2, wherein the thermoplastic material comprises polypropylene.

5. The pillow of claim 1, wherein the second panel comprises a plurality of yarns defining a plurality of interstitial spaces, the interstitial spaces being dimensioned such that a volume of air exiting the cavity proximate the seam during compression of the pillow is greater than a volume of air passing through the second panel during compression of the pillow.

6. The pillow of claim 1, wherein the casing defines a single cavity.

7. The pillow of claim 1, wherein the seam comprises an inner line of stitches defining a central portion of the first panel and a central portion of the second panel.

8. The pillow of claim 7, wherein the central portion of the first panel is free of needle holes.

9. The pillow of claim 8, wherein the central portion of the second panel is free of needle holes.

10. The pillow of claim 1, wherein the pneumatic resistance to compression provided by the casing is greater than the mechanical resistance to compression provided by the fill.

11. The pillow of claim 1, wherein the fill comprises down.

12. The pillow of claim 11, wherein the down comprises goose down.

13. The pillow of claim 12, wherein the goose down comprises down from a species of goose found in Northern Europe.

14. The pillow of claim 1, wherein the fill comprises one or more fibers.

15. The pillow of claim 1, the interstitial spaces being sufficiently small to preclude the fill from passing therethrough.

16. The pillow of claim 15, wherein the fill comprises one or more fibers; and a maximum extent of the interstitial spaces is smaller than a first diameter of the one or more fibers.

17. The pillow of claim 15, wherein:

each yarn has a second diameter; and a ratio of the second diameter to the first diameter is smaller than about 5.

18. The pillow of claim 17, wherein the ratio of the second diameter to the first diameter is smaller than about 1.

19. The pillow of claim 15, wherein the fill comprises down; and the interstitial spaces are dimensioned so as to preclude down from passing therethrough.

20. The pillow of claim 15, wherein the fill comprises down; and a maximum extent of the interstitial spaces is smaller than a maximum extent of a spike of a down plumule.

21. The pillow of claim 15, wherein:

each yarn has a second diameter; and a ratio of the second diameter to a maximum extent of a spike of a down plumule is smaller than about 3.

22. The pillow of claim 15, wherein the ratio of the second diameter to a maximum extent of a spike of a down plumule is smaller than about 1.

23. The pillow of claim 15, wherein the first panel and the second panel define a single cavity.

24. The pillow of claim 1, wherein the first panel and the second panel are coupled to one another at a flange, the flange extending away from the cavity.

25. The pillow of claim 24, further including a hanging component fixed to the flange.

26. The pillow of claim 25, wherein the hanging component comprises a loop.

27. The pillow of claim 24, wherein the flange comprises a bead.

28. The pillow of claim 27, wherein the bead defines one or more radiused corners of the pillow.

29. The pillow of claim 27, wherein the bead comprises a single cord encircling the pillow.

30. The pillow of claim 27, wherein the bead comprises a wrap disposed about the cord.

31. The pillow of claim 30, wherein the wrap comprises a tail that extends between a peripheral portion of the first panel and a peripheral portion of the second panel.

32. The pillow of claim 24, further comprising an inner row of stitches extending through the flange.

33. The pillow of claim 32, further comprising an outer row of stitches extending through the flange.

34. The pillow of claim 1, further comprising:

a component provided at a position along the casing for receiving a suspension device.

35. The pillow of claim 34, wherein the component is a loop.

36. The pillow of claim 34, wherein the component is elastic.

37. The pillow of claim 34, wherein the component is provided at a corner along the casing.

38. The pillow of claim 34, wherein the casing is manufactured from a fast-drying material.

39. The pillow of claim 1, the casing having a front side and a back side, each of the front and back sides including top, bottom first, and second edges, the front and back sides meeting along the top, bottom, first and second side edges; and a component provided at a position along the top, bottom, first or second side edge for receiving a suspension device.

40. The pillow of claim 39, further including a cording providing along the meeting of the top, bottom, first and second side edges of the front and back sides.

41. The pillow of claim 39; wherein the component is an extension of the cording.

42. The pillow of claim 39, wherein the component is elastic.

43. The pillow of claim 39, wherein the component is provided at a corner of two of the edges of the casing.

44. The pillow of claim 1, further comprising a pillow cover having:

a front cloth having a top edge, a bottom edge, a first side edge and a second side edge, the top edge of the front cloth extending to form a front flap;

a back cloth having a top edge, a bottom edge, a first side edge, and a second side edge, the top edge of the back cloth extending to form a back flap;

wherein the front and back cloths are joined along the bottom, first and second side edges, the back flap extending under the front cloth and the front flap overlaying the back flap and extending over the back cloth, and wherein the back and front flaps are joined with the front and back cloths along the first and second edges.

45. The pillow cover of claim 44, wherein the front flap is configured such that extension of the front flap over the back cloth forms a curved overlay.

* * * * *